United States Patent [19]

Harvey

[11] 4,180,105

[45] Dec. 25, 1979

[54] ARTICLE INFLATING SYSTEM

[75] Inventor: Albert J. Harvey, Fairfield, Ohio

[73] Assignee: Diamond International Corporation, New York, N.Y.

[21] Appl. No.: 955,370

[22] Filed: Oct. 27, 1978

[51] Int. Cl.[2] ..... B65B 57/02; B65C 3/26; B65B 31/02

[52] U.S. Cl. ..... 141/165; 53/88; 53/385; 156/156

[58] Field of Search ..... 156/156, 538; 53/88, 53/110, 385; 141/165, 114, 313, 67

[56] References Cited

U.S. PATENT DOCUMENTS

| | | | |
|---|---|---|---|
| Re. 28,350 | 3/1975 | Lerner | 53/385 |
| 3,157,011 | 11/1964 | Wheatley | 53/110 |
| 3,216,874 | 11/1965 | Brown | 156/156 |
| 4,033,091 | 7/1977 | Saponara | 53/88 |
| 4,140,159 | 2/1979 | Domke | 53/110 |

*Primary Examiner*—Douglas J. Drummond
*Attorney, Agent, or Firm*—Kenyon & Kenyon

[57] ABSTRACT

An article inflating system for engaging and inflating articles to be decorated is disclosed. A plurality of spaced cup-shaped nozzles are disposed on a horizontal moving endless belt so as to allow the cup-shaped nozzles to engage the article prior to decoration and assume a sealed relation therewith while passing through the decorating station. While at the decorating station, the open end of the cup-shaped nozzle is positioned in communication with an air supply manifold disposed adjacent the decorating station to enable inflation of the article during decorating. After the label has been applied to the article, the nozzle is gradually lifted out of engagement with the decorated article while the latter is conveyed away from the decorating station.

12 Claims, 5 Drawing Figures

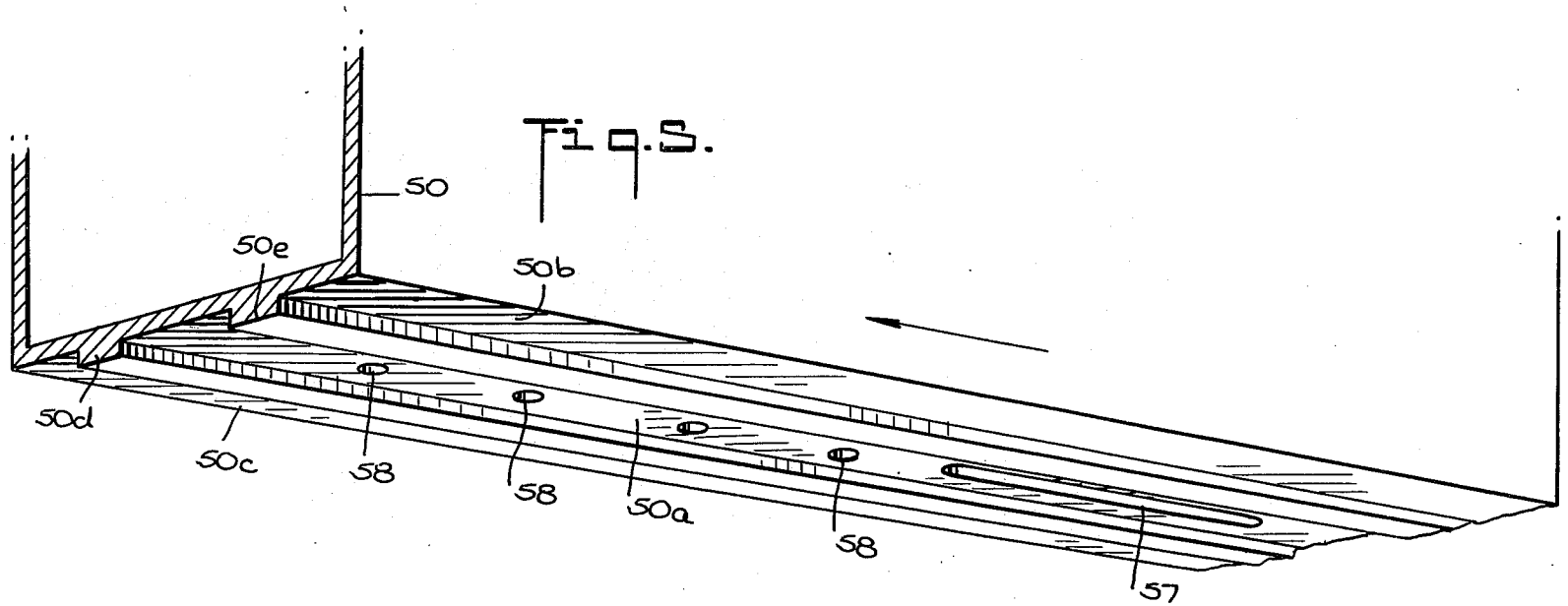
Fig. 5.
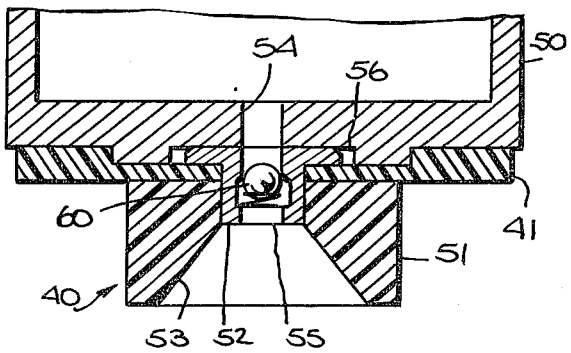
Fig. 4.
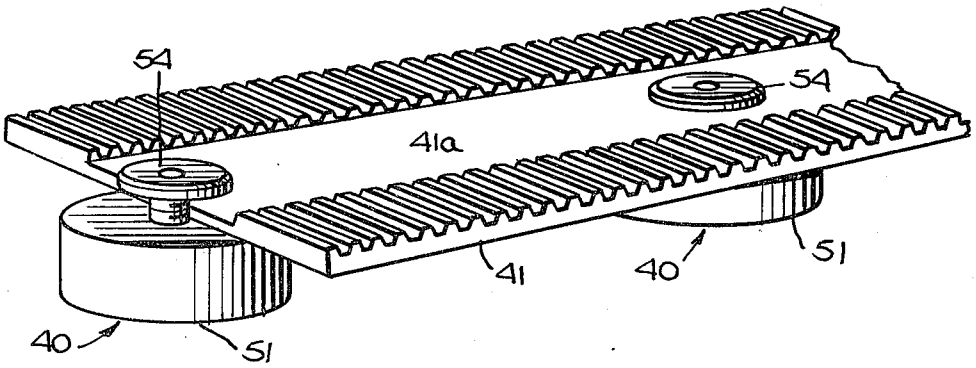

ARTICLE INFLATING SYSTEM

BACKGROUND OF THE INVENTION

This invention relates generally to an inflating system for articles being decorated and more particularly to one wherein the articles to be decorated, such as plastic containers and the like, are inflated while moving through a decorating apparatus.

With inflatable containers, particularly those having relatively thin plastic walls, it is generally required that the container be inflated during the decorating step. Numerous prior art inflating systems have been disclosed and generally are of a type in which a protruding member engages the open end of the container and the desired amount of air is introduced into the container to provide structural support during the decorating step. These prior art devices have generally been incorporated in an apparatus wherein the container is at rest while the inflating nozzle is inserted. This, of course, inhibits high speed decorating in that the containers are not continuously conveyed through the decorating apparatus. Further, the prior art inflating nozzles have generally required complex moving mechanisms including seals and the like which require frequent maintenance. By the means disclosed herein, a system is provided which permits the inflation of articles at a decorating station without any interruption of the movement of the article being conveyed through the decorating apparatus.

SUMMARY OF THE INVENTION

Briefly stated, the invention disclosed herein provides an article inflating system adapted to engage and inflate an open ended article being decorated at a decorating station. Included in the system is an air manifold for providing an air supply at a predetermined pressure to enable the inflation of the article during the decorating step. An endless belt is disposed so as to pass in engagement with the air manifold, the belt including a plurality of spaced openings therein. A drive means is further provided for driving the endless belt. Into each of the endless belt openings is fastened a cup-shaped nozzle which includes an opening extending therethrough and an article engaging surface adapted to facilitate a sealing relationship with the open end of the article to be decorated. Also included in the nozzle is a means for engaging the nozzle opening with the air manifold at the decorating station so as to facilitate the inflation of the article being decorated.

In the preferred embodiment, the cup-shaped nozzle is formed with a flat recessed portion disposed adjacent a central opening therein. The flat recessed portion terminates adjacent an inclined portion of the nozzle which extends outwardly therefrom. The shape of the nozzle readily permits centering of the open end of the container with the opening in the nozzle. A flanged sleeve member is provided to fasten each of the cup-shaped nozzles to the endless belt. The flanged sleeve member has a centrally open sleeve portion adapted to engage and fit within the central opening extending through the cup as well as the opening in the endless belt. The flange portion extends outwardly from the sleeve portion thus serving to hold the flanged sleeve member in engagement with the endless belt while the cup is in holding engagement with the opposite side thereof.

The flange portion of the sleeve member is adapted to engage the manifold assembly in a sealing relation. In this respect, the manifold is provided with an elongated groove disposed with its longitudinal axis extended substantially parallel to that of the endless belt. The groove which is disposed for at least the length of decorating station is of a width sufficient to engage the flange portion in a sealing relation while the latter is passing through the decorating station. Disposed in the groove is an elongated opening for introducing low pressure, high volume air into the container prior to decoration. Further provided in the groove are spaced openings for introduction of high pressure air just prior to and during decoration. To maintain pressurization of the container during decoration, a check valve may be incorporated in the nozzle.

Accordingly, it is an object of this invention to provide an article inflating means suitable for engaging an article to be decorated at a decorating station.

It is another object of this invention to provide an article support system which is adapted to inflate the article at a decorating station without interrupting the movement of the article passing through the decorating apparatus.

It is a further object of this invention to provide an article inflating system which is highly reliable and relatively maintenance free.

These, and other objects and features of the invention will become more apparent from the following description taken in conjunction with the accompanying drawing.

BRIEF DESCRIPTION OF THE DRAWING

FIG. 4 is an enlarged cross-sectional view, taken along line 4—4 in FIG. 1, of the article inflating system of this invention; and FIG. 5 is a fragmentary perspective view of the lower portion of the manifold assembly engaged by the cup-shaped nozzle.

DESCRIPTION OF THE PREFERRED EMBODIMENT

While the article inflating system disclosed herein is suitable for various types of decorating systems, the preferred embodiment is described with respect to a heat transfer labeling apparatus. The heat transfer labeling apparatus is more fully described in my co-pending patent application Ser. No. 955,372, entitled HEAT TRANSFER LABELING MACHINE, with certain aspects thereof being more fully described in my other co-pending application Ser. No. 955,317, entitled ARTICLE SUPPORT SYSTEM. Although the preferred embodiment will be described with respect to such a structure, it is not intended that the article inflating system of this invention be limited to only that particular type of an apparatus.

Figure 1:
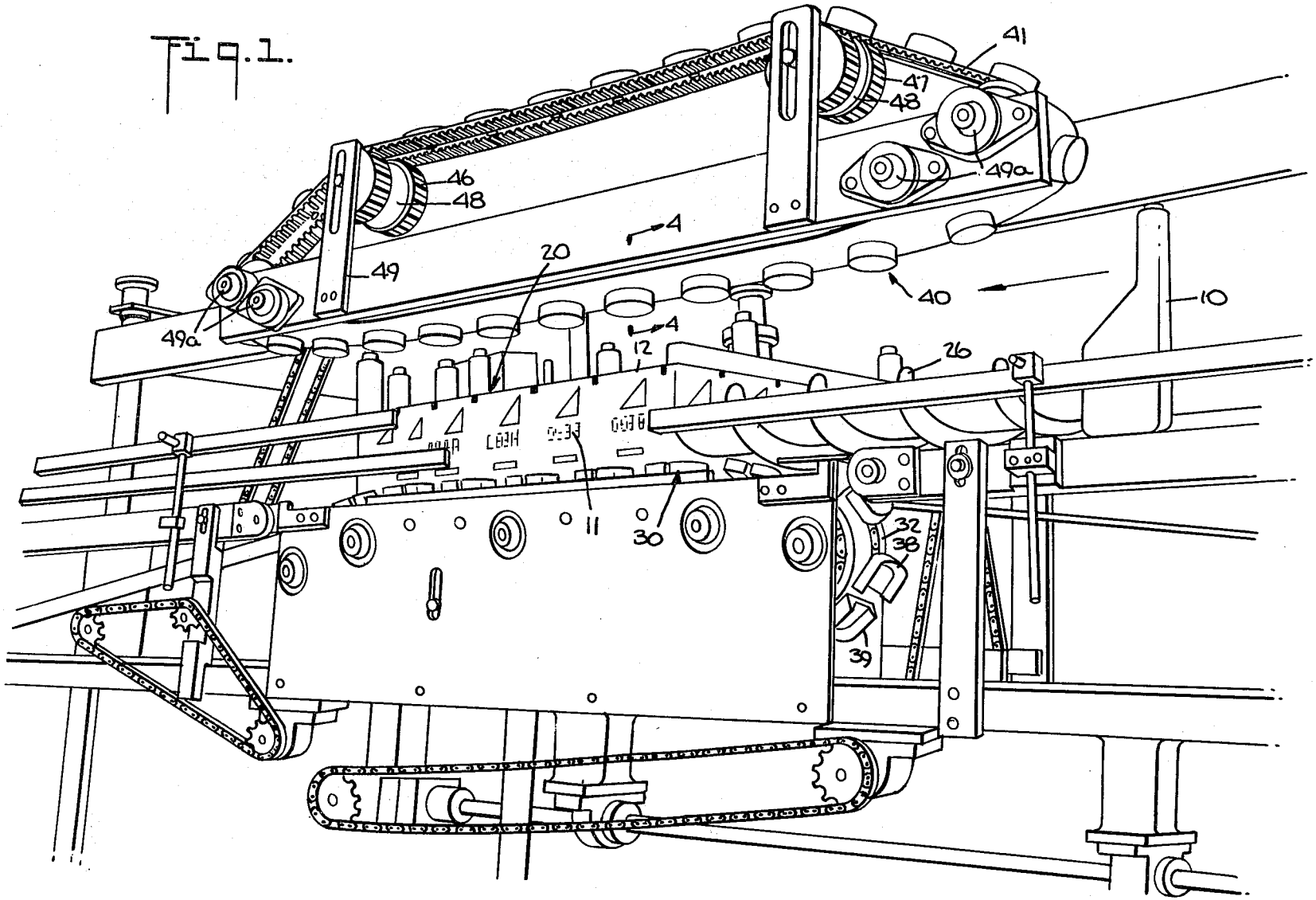
FIG. 1 is a front perspective view of a heat transfer labeling machine including the article inflating system of this invention.
Figure 2:
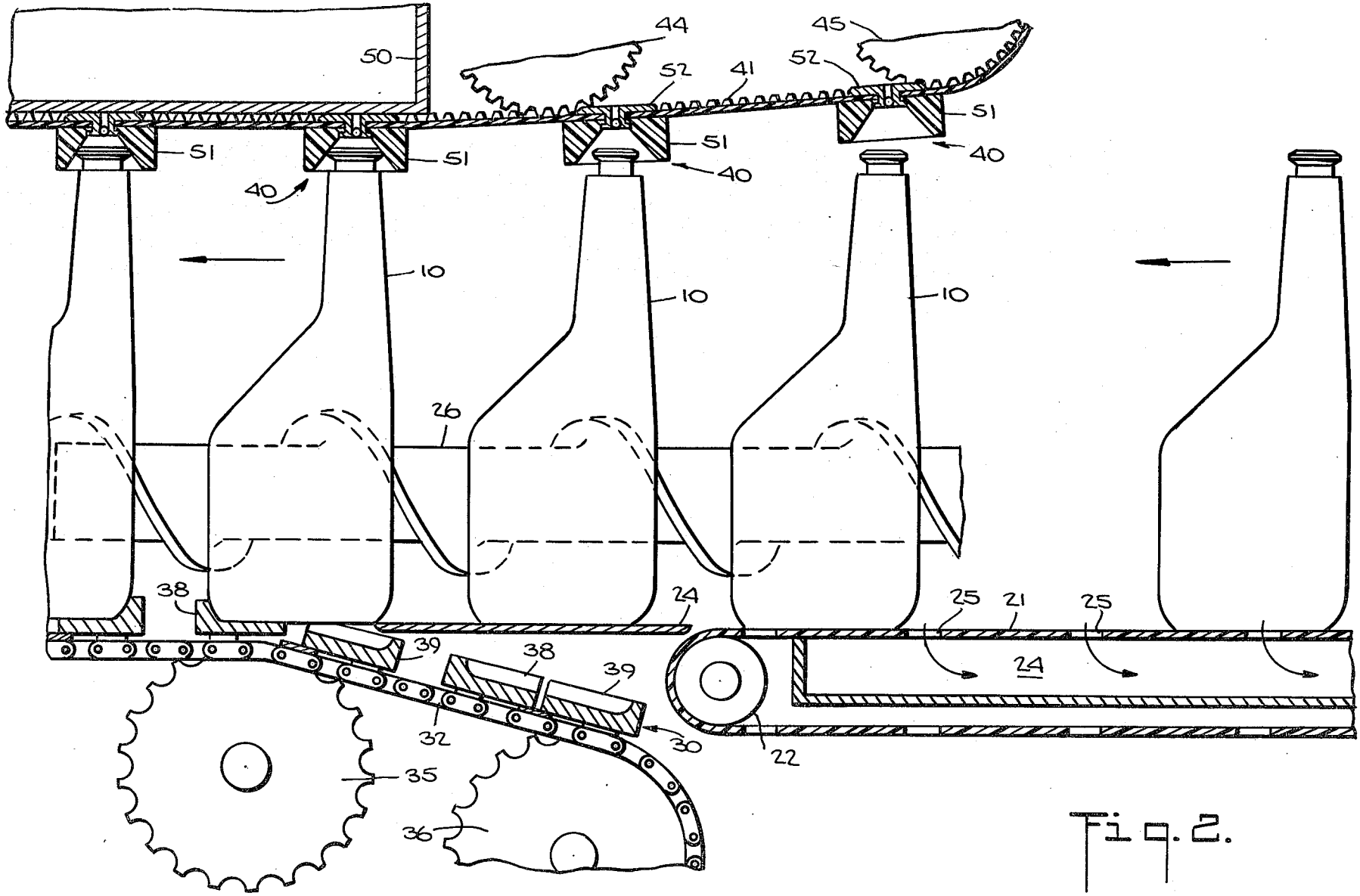
FIG. 2 is an enlarged front elevation view illustrating containers entering the decorating station.
Figure 3:
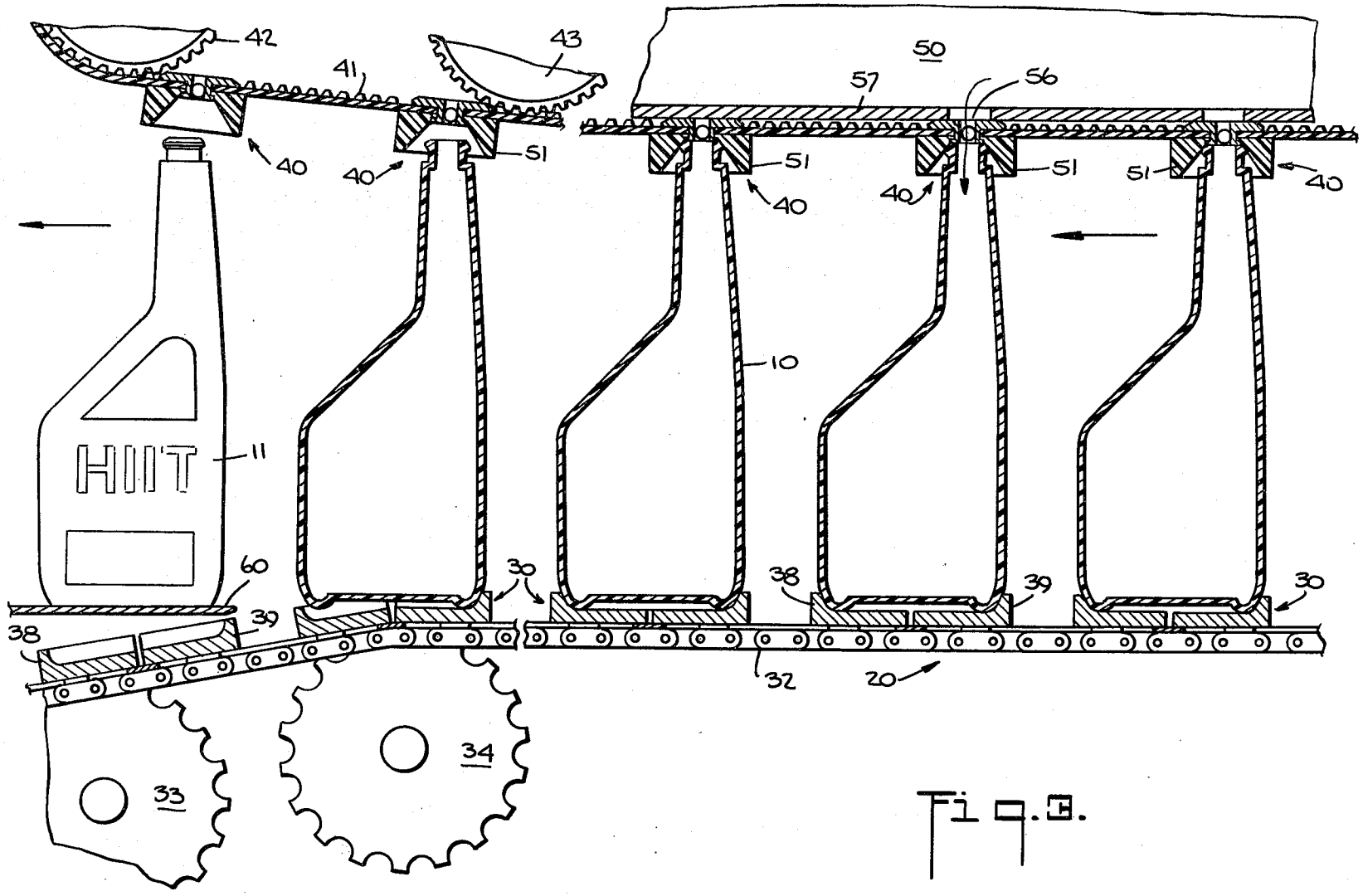
FIG. 3 is an enlarged front elevation view illustrating containers leaving the decorating station.

The article inflating system of this invention is described with its general application to the heat transfer labeling apparatus by reference to FIGS. 1 through 3. An irregular shaped container 10, having a substantially flat bottom is moved in the direction of the arrow to a decorating station indicated generally at 20 at which a label 11 is applied. Label 11 is carried to decorating station 20 by a web 12 which includes thereon a plurality of spaced labels 11.

Container 10 is conveyed toward the decorating station 20 by a horizontally disposed endless belt 21 which passes over drive wheel 22 and a similar one disposed at the other end thereof. Mounted within the endless belt 21 is a vacuum chamber 24 which has its upper surface in engagement with the inside portion of the belt 21. Disposed in the center of the belt 21 is a plurality of spaced apertures 25 which permit a vacuum to be applied to the bottom of the container 10 thus holding and stabilizing the container during movement. Disposed adjacent to the end portion of belt 21 is a feedscrew 26 which has a pitch suitable for engagement with the particular size container 10 being decorated. The container 10 is engaged by the threaded portion of feedscrew 26 and fed to a receptacle holding means 30. To facilitate feeding of container 10 into receptacle holding means 30, a horizontal plate 24 is disposed at the end of belt 21 to assist in transposing the container from the conveyor belt 21 into the receptacle 30 (FIG. 2).

Receptacles 30 are fastened to an endless chain 32 which is driven over sprockets 33, 34, 35 and 36. Chain 32 is a link type to which the receptacle 30 is fastened. Receptacle 30 consists of split halves 38 and 39 which have a deep dish contour that substantially matches the bottom portion of the container 10 being decorated. Container 10 is fed by feedscrew 26 into the receptacle 30 with the leading bottom edge of the container engaging the leading or forward half 38 of the receptacle 30 (see FIG. 2). As the container moves forward and while still engaged with the feedscrew 26, chain 32 moves over pulley 35 with the trailing half 39 of the receptacle 30 moving up and into holding engagement with the bottom of container 10.

As the lower portion of container 10 is being moved into receptacle 30, the upper open portion of the container has already been moved into engagement with the cup-shaped inflating nozzle 40. The cup-shaped inflating nozzle 40 is attached to a timing belt 41 which is driven at the same speed as the containers being fed by the feedscrew 26 and conveyor 21. In this manner, as the cup-shaped nozzle 40 descends into engagement with the container 10, its speed is synchronized so as not to disturb the container being fed into the decorating station. Thus, as the lower portion of container 10 is engaged with feedscrew 26, the open upper end of the container is engaged by nozzle 40. Timing belt 41 is provided with teeth engagable with drive gears 42, 43, 44, 45, 46 and 47. Each of the drive gears is formed with an internal recessed portion 48 to permit passage of cup-shaped nozzle 40 thereover. End drive gears 42 and 45 are positioned with their axis above that of the inner drive gears 43 and 44 so that timing belt 41 is on an incline between the adjacently spaced drive gears 42–43 and 44–45 respectively.

Drive gears 46 and 47 (FIG. 1) engage the upper portion of timing belt 41 and are mounted in slotted support members 49. Support members 49 permit adjustment of each of the drive gears 46 and 47 so that the tension of timing belt 41 may be adjusted. The remaining drive gears 42 through 45 are suitably mounted in bushings 49*a*. Disposed between the upper and lower portions of timing belt 41 is an air manifold 50 to facilitate inflating container 10 while at decorating station 20.

A plurality of cup-shaped nozzles 40 are spaced from one another on timing belt 41 and include a container engaging cup 51. The center portion of cup 51 is recessed and of a size compatible for engaging the top opening of the container 10. Cup 51 is preferably fabricated from a nylon material. Recessed cup 51 includes a flat container engaging surface 52 which terminates adjacent the inclined wall 53, the latter assisting in centering the open end of container 10 with the cup 51.

Bushing 54 is threaded into the center opening 55 of cup 51, the bushing serving to fasten cup 51 to timing belt 41. Bushing 54 is preferably fabricated from a soft metal such as bronze. In order to permit passage of the flange portion 56 of bushing 54, gears 42–47 are recessed at 48 and do not engage the center portion of timing belt 41. Similarly, the center portion of timing belt 41 is relieved at 41*a* to facilitate fastening of nozzles 40 thereto. Flange portion 56 of bushing 54 is circular having a diameter slightly less than the width of groove 50*a* provided in the lower portion of manifold 50. Manifold 50 is relieved at each side thereof, i.e., 50*b* and 50*c*, thus forming rails 50*d* and 50*e*, the inner surfaces of which serve as a guide for flange position 56 when timing belt 41 is in engagement with the lower portion of manifold 50.

Air is permitted to enter the container 10 prior to arrival at decorating station 20 via the elongated opening 57 in manifold groove 50*a*. This initial inflation of container 10 is accomplished using a high volume of air pressurized to three inches of water. As the container is inflated with such relatively high volume of air through elongated opening 57, sufficient circulation exists of neutralize static charges on the inner surfaces of the container when such inflation is employed in conjunction with the injection of ionized air. Thus, static charges, such as those which may be created during the molding process, may be neutralized. High pressure air is subsequently introduced into container 10 through the spaced openings 58. In this manner, it has been found that high pressure air, injected at spaced intervals provides sufficient pressurization of the container for decorating. The spaced openings are positioned in a separate chamber of air manifold 50 which is supplied with air at 25 psig.

In order to preclude loss of air from the container during decorating as well as delivery to decorating station 20, in certain instances it is desirable to employ a check valve in nozzle 40. Such a valve 60 is illustrated in FIG. 4, the ball being positioned in bushing 54 and spring biased into engagement with the bushing to preclude loss of any substantial amount of air through nozzle 40.

Referring to FIGS. 2–3, the nozzles 40 are spaced from one another on timing belt 41 a distance identical to the spacing between receptacles 30 on link chain 32. Thus, as the container is moved through the decorating station it is securely held both at the top and bottom. As the container 10 is fed by screw 26 toward the decorating station 20, a cup-shaped nozzle 40 begins to descend over the container. With reference to FIG. 2, nozzle 40 passes over drive gear 45, and descends as it is moved towards drive gear 44. Before the container bottom is securely held in receptacle 30, cup-shaped nozzle 40 is lowered into a container engaging position as it passes over the centerline of drive gear 44. As mentioned, openings 58 are provided in manifold 50 and prior to the decorating station 20. In this manner air inflates the container 10 during the period which it is engaged by the transfer rollers applying a label 11 thereto.

Once the container leaves decorating station 20, at which label 11 was applied, it is routed onto an exit conveyor by first passing over plate 60. A vacuum chamber is also disposed between the upper and lower surfaces of the exit conveyor belt. The exit conveyor belt contains slots in the center portion thereof similar to those in conveyor 21, to permit the application of a vacuum to the lower portion of container 10. Container 10 is discharged from the receptacle 30 as the leading portion moves downward and out of engagement with container 10 after the receptacle passes over sprocket 34. While the trailing half 39 of the receptacle 30 is still in engagement with the container, the forward portion of container 10 is moved on to plate 60 which is disposed between endless chain 32 and the exit conveyor. While on plate 60, movement of the container 10 is controlled by the trailing container which tends to push the container onto plate 60 and then the exit conveyor. As the receptacle 30 drops out of engagement with the container, inflating nozzle 40 is similarly disengaged from the open top portion of container 10. As each nozzle 40 passes over gear 43, it is moved in an upward direction towards the next drive gear 42. This thus causes the recessed portion of nozzle 40 to lift out of engagement with container 10. The decorated bottle which is removed from the apparatus by the exit conveyor is then ready for filling or other further processing. It is noted that the speeds obtainable with the heat transfer labeling apparatus of this invention (over 200 labels per minute) make the equipment suitable to serve as an in-line piece of equipment along with filling machines and associated equipment.

Thus there has been described an article inflating system suitable for engaging and inflating an article at a decorating station. The system herein described permits the continued feeding of the article to be decorated into engagement with the inflating nozzle without any interruption of forward movement of the article being decorated. Further, the system described herein is highly reliable and relatively maintenance free.

Although the above description is directed to the preferred embodiment of the invention, it is noted that other variations and modifications will be apparent to those skilled in the art, and may be made without departing from the spirit or scope of the present disclosure.

What is claimed is:

1. An article inflating system adapted to engage and inflate an open ended article being decorated at a decorating station which comprises an air manifold for providing an air supply at a predetermined pressure suitable for inflating said article;

an endless belt disposed so as to pass in operative engagement with said air manifold and having a plurality of spaced openings therein;

means for driving said endless belt;

a plurality of cup-shaped nozzles fastened to said endless belt, each of said nozzles having an opening extending therethrough and an article engaging surface to facilitate a sealing relationship with the open end of the article to be decorated; and means for engaging said opening with said air manifold at the decorating station to facilitate the inflation of said article being decorated.

2. The system of claim 1 wherein the article engaging surface of said cup-shaped nozzles comprise a substantially flat recessed portion disposed adjacent said opening, said recessed portion terminating adjacent an inclined portion extending outwardly therefrom.

3. The system of claim 1 which further includes a flanged sleeve member adapted to fasten each of said plurality of cup shaped nozzles to said endless belt, said flanged sleeve member having a centrally open sleeve portion adapted to engage and fit within a central opening extending through said cup and a flange portion extending outwardly from said sleeve portion suitable for holding said member in engagement with said endless belt while said cup is in holding engagement with the opposite side of said endless belt.

4. The system of claim 3 wherein said flanged portion is adapted to sealingly engage said manifold assembly.

5. The system of claim 4 wherein said manifold assembly includes an elongated grooved portion disposed adjacent said decorating station with its longitudinal axis extending substantially parallel to that of said endless belt, said grooved portion being of a width sufficient to engage said flanged portion in a sealing relation at said decorating station.

6. The system of claim 5 wherein said grooved portion of said manifold assembly includes therein an elongated opening disposed upstream of said article being decorated and a plurality of smaller openings disposed adjacent said decorating station, said elongated opening being provided with a high volume of pressurized air for introduction into said article and said smaller openings being provided with pressurized air at a pressure greater than that at said elongated opening for introduction into said article to be decorated.

7. The system of claim 1 wherein said endless belt comprises a timing belt including a plurality of teeth-like members on one surface thereof adapted to be driven by said driving means.

8. The system of claim 7 wherein said driving means comprises a plurality of rotatably driven gear members engaged with the toothed side of said endless belt, each of said gear members having the center portion of the belt engaging surface recessed to facilitate passing of said cup-shaped nozzle thereover.

9. The system of claim 8 wherein said gear members disposed in engagement with the end portion of said timing belt are disposed above the plane of said timing belt passing through said decorating station.

10. The system of claim 1 which further includes check means disposed in each of said cup-shaped nozzles adapted to preclude any substantial loss of air from said inflated article while being decorated.

11. An article inflating system adapted to engage and inflate an open ended article being decorated at a decorating station which comprises an air manifold for providing an air supply at a predetermined pressure suitable for inflating said article;

an endless belt disposed so as to pass in operative engagement with said air manifold and having a plurality of spaced openings therein;

a plurality of rotatable members engaged with the inner side of said endless belt being driven thereabout, said rotatable members in engagement with the end portion of said endless belt being disposed above the plane of said endless belt passing through said decorating station;

means for driving at least one of said rotatable members;

a plurality of spaced nozzles fastened to said endless belt, each of said nozzles having an opening extending therethrough and an article engaging surface to facilitate a sealing relationship with the open end of the article to be decorated; and means for engaging said opening with said air manifold at the decorating station to facilitate the inflation of said article being decorated.

12. The system of claim 11 wherein said endless belt comprises a timing belt including a plurality of teeth-like members on the inner surface thereof and said rotatable members comprise gear members having the center portion of the belt engaging surface recessed to facilitate passage of said spaced nozzles thereover.

* * * * *